US006352390B1

(12) United States Patent
Jones

(10) Patent No.: US 6,352,390 B1
(45) Date of Patent: Mar. 5, 2002

(54) APPARATUS FOR LIFTING AND SUPPORTING A FOUNDATION UNDER TENSION AND COMPRESSION

(76) Inventor: Robert L. Jones, 29505 Golden Gate Canyon Rd., Golden, CO (US) 80403

( * ) Notice: Subject to any disclaimer, the term of this patent is extended or adjusted under 35 U.S.C. 154(b) by 0 days.

(21) Appl. No.: 09/639,617

(22) Filed: Aug. 15, 2000

(51) Int. Cl.[7] ..... E02D 5/00; E02D 5/80

(52) U.S. Cl. ..... 405/230; 405/231; 405/244; 52/169.2; 52/169.9; 52/169.13

(58) Field of Search ..... 405/230–233, 405/239, 244, 249, 251; 52/720.1, 153–166, 169.1, 169.2, 169.9, 169.13, 40

(56) References Cited

U.S. PATENT DOCUMENTS

| | | | | | |
|---|---|---|---|---|---|
| 4,070,867 | A | | 1/1978 | Cassidy | |
| 4,634,319 | A | | 1/1987 | May | |
| 4,765,777 | A | * | 8/1988 | Gregory | 405/230 |
| 4,854,782 | A | | 8/1989 | May | |
| 4,911,580 | A | | 3/1990 | Gregory et al. | |
| 5,011,336 | A | | 4/1991 | Hamilton et al. | |
| 5,013,190 | A | * | 5/1991 | Green | 405/230 |
| 5,120,163 | A | * | 6/1992 | Holdeman et al. | 405/230 |
| 5,139,368 | A | | 8/1992 | Hamilton et al. | |
| 5,171,107 | A | | 12/1992 | Hamilton et al. | |
| 5,213,448 | A | * | 5/1993 | Seider et al. | 405/230 |
| 5,234,287 | A | * | 8/1993 | Rippe, Jr. | 405/230 |
| 5,482,407 | A | | 1/1996 | Raaf | |
| 5,722,798 | A | | 3/1998 | Gregory | |
| 5,800,094 | A | | 9/1998 | Jones | |
| 5,951,206 | A | | 9/1999 | Gregory | |

* cited by examiner

*Primary Examiner*—Thomas B. Will
*Assistant Examiner*—Tara L. Mayo
(74) *Attorney, Agent, or Firm*—Dorr, Carson, Sloan & Birney, P.C.

(57) ABSTRACT

An apparatus for lifting and supporting a foundation of a structure under tension and compression relative to a pier anchored into the ground. The apparatus comprises a support member connected to the foundation by a plate and a V-shaped brace. A rod passes through the support member and is connected to the pier. Two fasteners threadably engage the rod above and below the support member, respectively, so that the central support member remains slidable along the rod between the first and second fasteners. A lift bracket is removably connected to the support member and a jack is inserted between the rod and the lift bracket. The jack is operated to exert a force between the rod and the lift bracket so that the support member slides along the rod between the first and second anchors as the foundation is lifted. The first and second anchors are then tightened against the support member so that it is held firmly in place relative to the rod to support the foundation under tension and compression. The lift bracket and jack can then be removed.

17 Claims, 5 Drawing Sheets

APPARATUS FOR LIFTING AND SUPPORTING A FOUNDATION UNDER TENSION AND COMPRESSION

BACKGROUND OF THE INVENTION

1. Field of the Invention

The present invention relates generally to the field of foundation supports. More specifically, the present invention discloses an apparatus for lifting and supporting a foundation of a structure under tension or compression.

2. Statement of the Problem

The surface of the ground is made up of clays such as bentonite or other unstable soils in many areas throughout the country. The surface of the ground in these areas tend to heave and/or to sink, especially when subject to heavy rainfall, freezing and thawing temperatures, etc. This heaving and sinking causes the foundation of structures (e.g., houses, buildings, etc.) built on this soil to weaken, and may cause severe damage to the foundation and structure. Therefore, the foundations of these structures must be secured in the stable subsurface (e.g., the bedrock or at least a stable geologic stratum). However, it is often cost prohibitive to remove the unstable soil and replace it or build the foundation directly on the stable subsurface. Instead, piers are driven into the stable subsurface and the foundation is attached at various points, depending on the size and weight of the structure and other design considerations, to the piers to stabilize the foundation of the structure. Helical piers are also used for other purposes, including tensile loads.

Foundation supports have been used in the past, including the following:

| Inventor | Patent No. | Issue Date |
|---|---|---|
| Cassidy | 4,070,867 | Jan. 31, 1978 |
| May | 4,634,319 | Jan. 6, 1987 |
| May | 4,854,782 | Aug. 8, 1989 |
| Gregory, et al. | 4,911,580 | Mar. 27, 1990 |
| Hamilton, et al. | 5,011,336 | Apr. 30, 1991 |
| Holdeman et al. | 5,120,163 | Jun. 9, 1992 |
| Hamilton et al. | 5,139,368 | Aug. 18, 1992 |
| Hamilton et al. | 5,171,107 | Dec. 15, 1992 |
| Seider et al. | 5,213,448 | May 25, 1993 |
| Raaf | 5,482,407 | Jan. 9, 1996 |
| Gregory | 5,722,798 | Mar. 3, 1998 |
| Jones | 5,800,094 | Sep. 1, 1998 |
| Gregory | 5,951,206 | Sep. 14, 1999 |

Cassidy discloses a skin friction pile. A hydraulic cylinder is used to drive the pile and casing.

May ('319) discloses a shoe attached to a structure. The shoe carries a pier driving assembly to drive a pier beneath the structure. A pier plate unit is fitted over the upper end of the pier and lifting means supported by the pier plate unit operate between the pier plate unit and the structure to lift the structure to a desired position. After the structure has reached this position, adjustable supporting means are placed between the pier plate unit and the structure to retain the structure in the desired position.

May ('782) discloses a shoe attached to the base of a structure. The shoe is guided and supported on the pier with a sleeve. A removable lift bracket is attached to the shoe and a jack is inserted between the top of the sleeve and the bottom of the lift bracket to raise the structure. Once the structure is at the desired level, pins 64 are inserted through the shoe and shims are inserted between laterally extending plates of the sleeve to permanently support the structure.

Gregory et al. ('580) disclose lifting the foundation a desired amount with ram units until the plate is spaced from its original position on the rods. Nuts are then advanced to engage the plate and secure the assembly. The hydraulic ram units and the lift bracketing assembly can then be removed.

Hamilton et al. ('336) disclose a threaded, force-transmitting bolt screwed into the bracket crosspiece that engages the anchor shaft so that the anchor becomes a load-bearing support for the foundation.

Holdeman et al. disclose an inverted U-shaped coupler adapted to be temporarily secured to a foundation support assembly. A jacking device is received between the top of the coupler at and the foundation support and force is applied to the coupler so that the foundation and support are carried by the screw anchor. The nuts are then rotated to engage the undersides of respective walls to firmly affix the cross member and tubular member to the bracket assembly. The jacking device is then removed.

The patents to Hamilton et al. disclose an assembly made up of channel, bolts and jacking nuts. A jack is positioned between the cross plate to lift the bracket assembly, after which the nuts are rotated to engage washers resting on the cross plate, firmly affixing the screw anchor to the bracket assembly. The jack can then be withdrawn and the assembly may be removed from the bolts.

Seider et al. disclose inserting a bonding composition into a sleeve that is then placed over a screw anchor. An upper bracket attached to the sleeve is then attached to the foundation. If the foundation must be lifted relative to the screw anchor, a jacking assembly is positioned on the top plate and the foundation is lifted. Once lifted, nuts are tightened onto the top plate and nuts are tightened against the seat and the jacking assembly is removed.

Raaf discloses a helical outrigger apparatus that is attached to an underpinning drive assembly for exerting an auxiliary anchoring force.

Gregory ('798) discloses arms expanded until the sleeve grasps the upper end portion of the pipe segment. The ram units are then retracted to exert a vertical force against the piling, thus lifting the foundation. A pair of nuts engage a plate to secure the system. The hydraulic ram units and lift bracket assembly and pipe segment are then removed.

Jones discloses a lifting assembly removably seated over the base of a support assembly and using two hydraulic jacks to lift the foundation. Once the foundation has been raised, the nuts are tightened against the top of the support assembly base and the jacks and the lifting assembly are removed from the support assembly.

Gregory ('206) discloses a piston that is extended to exert an upwardly-directed force against the frame which raises the upper mounting assembly and the lower mounting assembly. Rods also move upwardly a distance corresponding to the distance of the lift of the foundation. Nuts are then advanced to engage the plate, securing the foundation in its raised position.

A need still exists for an apparatus that is: (1) attachable to conventionally available piers, (2) capable of lifting the foundation to a desired level before securing it in place, (3) provides support for the foundation under both tension and compression, and (4) uses a releasable lift assembly that can be reused interchangeably with other supports.

3. Solution to the Problem

The apparatus of the present invention can be attached to conventionally available piers. In addition, the apparatus can be used to lift the foundation to a desired level before securing it in place. The apparatus also provides support for the foundation under both tension and compression. After use, the releasable jack and lift bracket can be reused interchangeably with other support members of the present invention.

SUMMARY OF THE INVENTION

The present invention is an apparatus for lifting and supporting a foundation of a structure relative to a pier anchored into the ground. A primary object of the invention is to provide a support for the foundation under tension and compression (i.e., to provide support against heaving and sinking). Another object of the invention is to provide a removable lift assembly that can be reused with other support members, and a support member that can be used with conventionally available piers.

The apparatus comprises a support member connected to the foundation by a plate and a preferably V-shaped brace. A rod passes through the support member and is connected to the pier. Two fasteners threadably engage the rod above and below the support member, respectively. As such, the central support member can be slid along the rod between the first and second fasteners. A lift bracket is preferably removably connected to the support member and a jack is inserted between the rod and the lift bracket. The jack is operated to exert a force between the rod and the lift bracket so that the support member slides along the rod between the first and second anchors as the support member lifts the foundation. The first and second anchors are then tightened against the support member so that it is held firmly in place relative to the rod to support the foundation under tension and compression. The jack and lift bracket can then be removed and used to lift other support members on the same or other foundations.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 3(*b*) is a front view of the apparatus in FIG. 3(*a*) after the foundation has been lifted.

FIG. 3(*c*) is a front view of the apparatus in FIG. 3(*b*) after the lift bracket and jack have been removed from the support member.

DETAILED DESCRIPTION OF THE INVENTION

1. Overview

Figure 1:
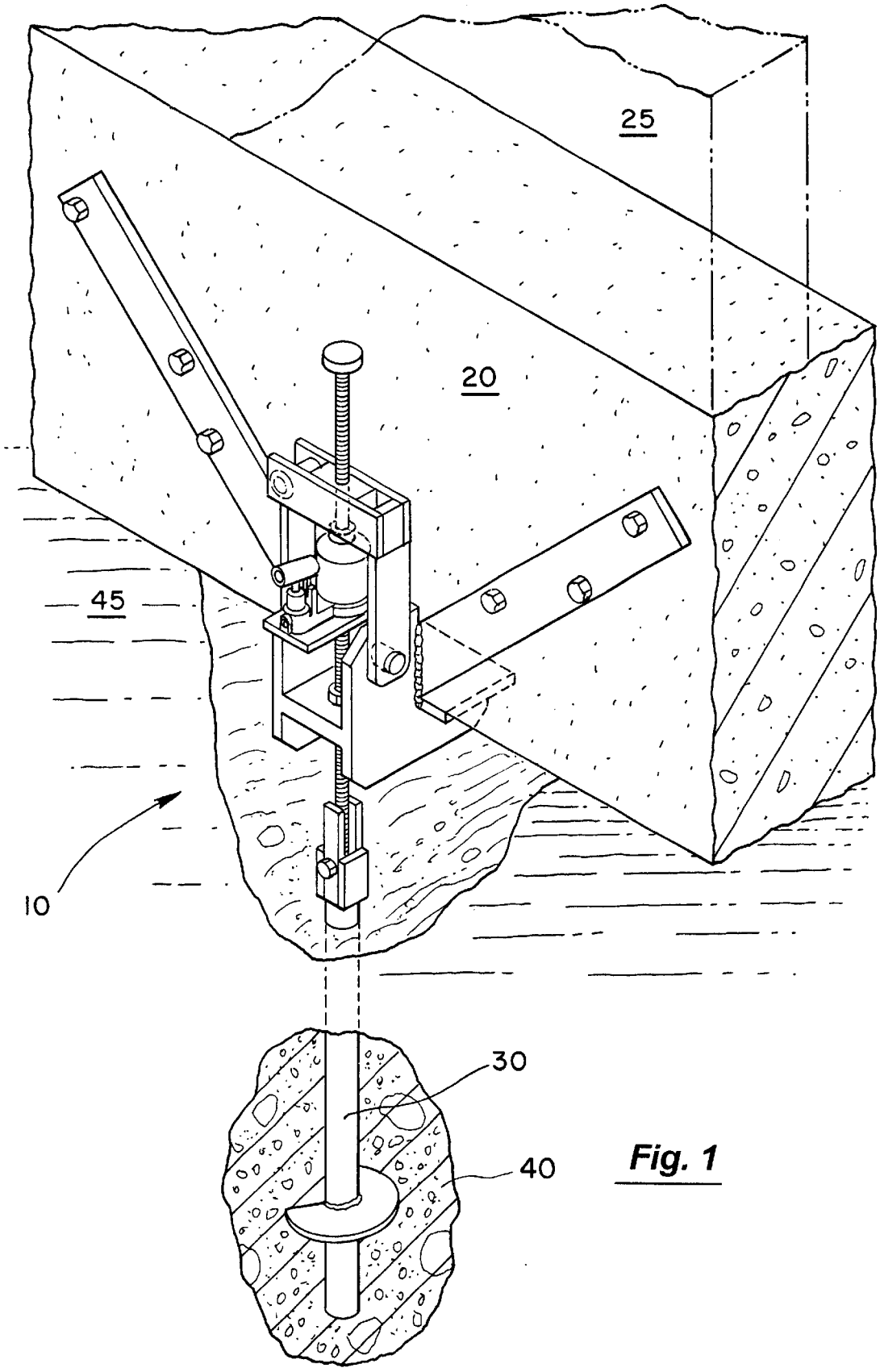
FIG. 1 is a perspective view of the apparatus of the present invention shown attached to the foundation of a structure.
Figure 2:
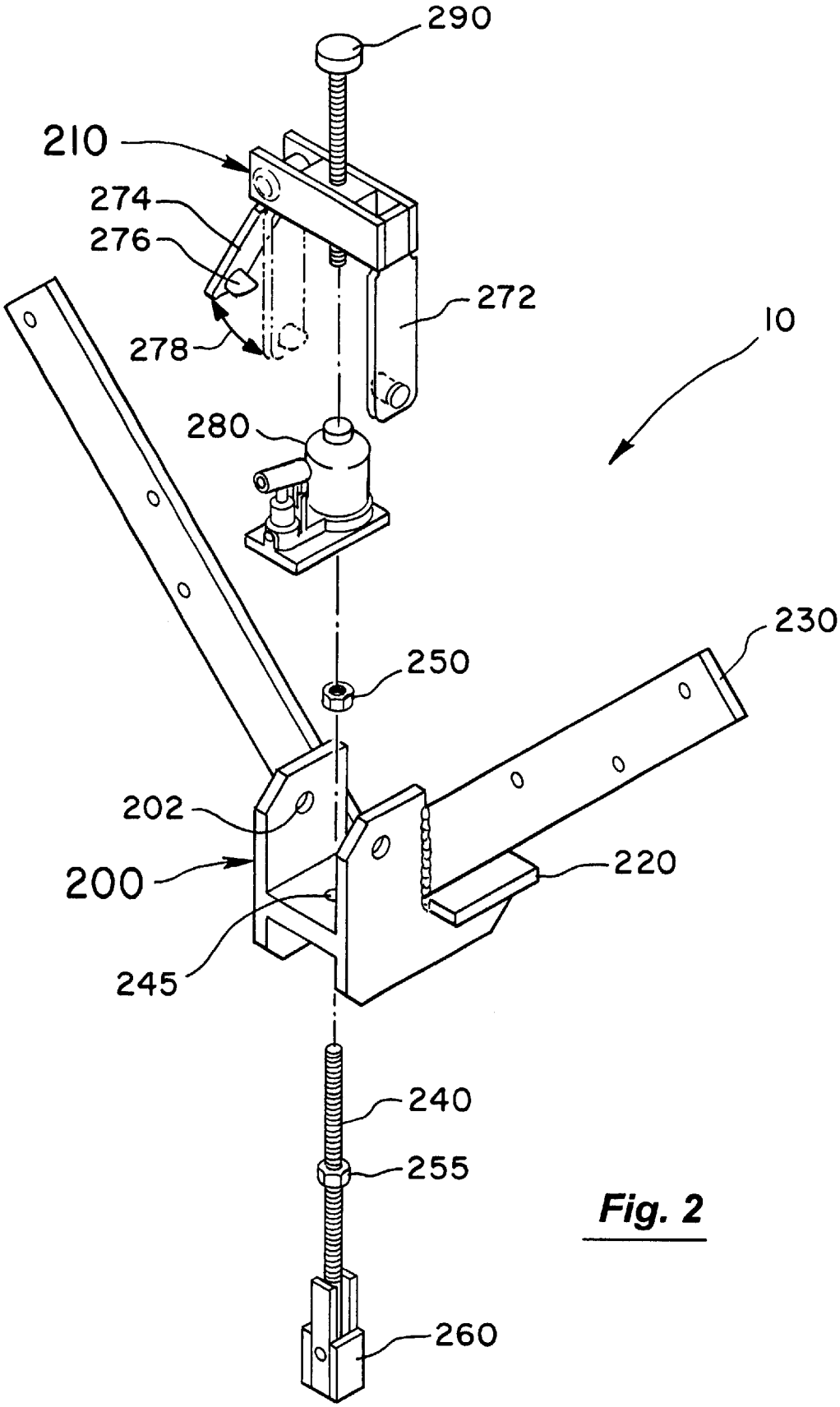
FIG. 2 is an exploded view of the apparatus of the present invention.

FIG. 1 is a perspective view of the apparatus 10 of the present invention shown attached to the foundation 20 of a structure 25 and connected to a conventional pier 30, such as a helical pier secured in the ground 40. The apparatus 10 has a support member 200, a removable lift bracket 210, and a jack 280, as shown in FIG. 2.

The support member 200 includes a plate 220 and a brace 230 attached thereto. A rod 240 passes through a hole 245 formed in the support member 200 so that the support member 200 is slidable along the length of the rod 240 between a first anchor 250 connected to the rod 240 above the support member 200 and a second anchor 255 connected to the rod 240 below the support member 200. The hole 245 formed in the support member 200 preferably has a larger diameter than that of the rod 240 so that the rod 240 readily slides through the hole 245 and the support member 200 thus readily slides along the length of the rod 240. The rod 240 has a connector 260 that engages the rod 240 and the upper end of the pier 30 to interconnect the rod 240 to the pier 30 as shown in FIG. 1.

The lift bracket 210 is preferably removable and includes a stationary arm 272 and a movable arm 274 with fittings 276 formed thereon. The lift bracket 210 is removably fit onto the support member 200. That is, the movable arm 274 is swung away from the stationary arm 272 (i.e., arrow 278) so that the fitting 276 of the stationary arm 272 can be fit into hole 202 formed on the support member 200. The movable arm 274 is then swung back toward the stationary arm 272 (i.e., arrow 278) so that the fitting 276 on the movable arm 274 engages the other hole 202 formed on the support member 200. The lift bracket 210 also preferably includes an adjustable member 290 that can be loosened or tightened to accommodate a jack 280 between the lift bracket 210 and the rod 240, as explained in more detail below. The jack 280 is preferably a commercially available hydraulic jack capable of lifting the structure 25.

It is to be understood, however, that the above-described lift bracket 210 is a preferred embodiment and other variations are possible under the teachings of the present invention. For example, fittings 276 can be on the support member 200 and fit into holes 202 formed on the arms 272, 274. Likewise, any suitable connection can be used in place of fittings 276 and holes 202 (e.g., pins, bolts, etc.), and the arms 272, 274 can both be movable, or can both be stationary (e.g., where a pin assembly is used to connect the lift bracket 210 to the support member 200)

In addition, although the adjustable member 290 preferably threadably engages the lift bracket 210, other embodiments are possible under the teachings of the present invention such as an adjustable member 290 that slidingly engages the lift bracket 210 and is held in place with pins or engages the lift bracket 210 by ratcheting. Alternately, the adjustable member 290 need not be provided at all. For instance, the entire lift bracket 210 may be adjustable on the support member 200 (e.g., multiple holes formed in the support member 200), or the jack 280 can be adjusted to fit between the support member 200 and the lift bracket 210.

It is to be understood that pier 30 can be any conventionally available pier and need not be the helical pier shown in the figures. Any suitable pier 30 can be used under the teachings of the present invention. In addition, although the plate 220 and brace 230 are preferably separate components welded to the support member 200, the plate 220 and brace 230 can be attached using any suitable means and indeed can even be integrally molded as part of the support member 200. Likewise, the brace 230 can be any suitable brace or bracket such as a flanged portion formed on the support member 200. However, the brace 230 is preferably V-shaped to distribute the forces acting on the foundation over a greater surface area.

It is to be further understood that although the rod 240 is preferably threaded and the first and second anchors 250, 255 are correspondingly threaded fasteners that threadably engage the rod 240, the rod 240 need not be threaded. For example, the rod 240 can instead be notched with corresponding ratchet-type fasteners, have pin holes formed therein with corresponding pin-type fasteners, a smooth rod with lift bracket-type fasteners, etc. In any event, suitable anchors 250, 255 are used to engage the rod 240 and limit the movement of the support member 200 along the rod 240 therebetween. Likewise, any suitable connector 260 can be used under the teachings of the present invention to interconnect the rod 240 to the pier 30. Typically, a helical pier has a square cross-section at its upper end that is used to drive the pier into the ground. The connector 260 thus preferably has a corresponding square socket to receive the end of the pier thereon. A removable pin can be used to secure the connector 260 to the helical pier. However, it is to be understood that other connectors 260 will occur to those skilled in the art, such as a double-threaded connector, or the connector can be seated using contact cement, pins, etc., or any combination thereof.

Furthermore, it is to be understood that the lift bracket 210 described above is a preferred embodiment, and other embodiments will occur to those skilled in the art. Likewise, any suitable jack 280 or other lifting device can be used under the teachings of the present invention.

2. Operation and Use of the Apparatus

Figure 3A:
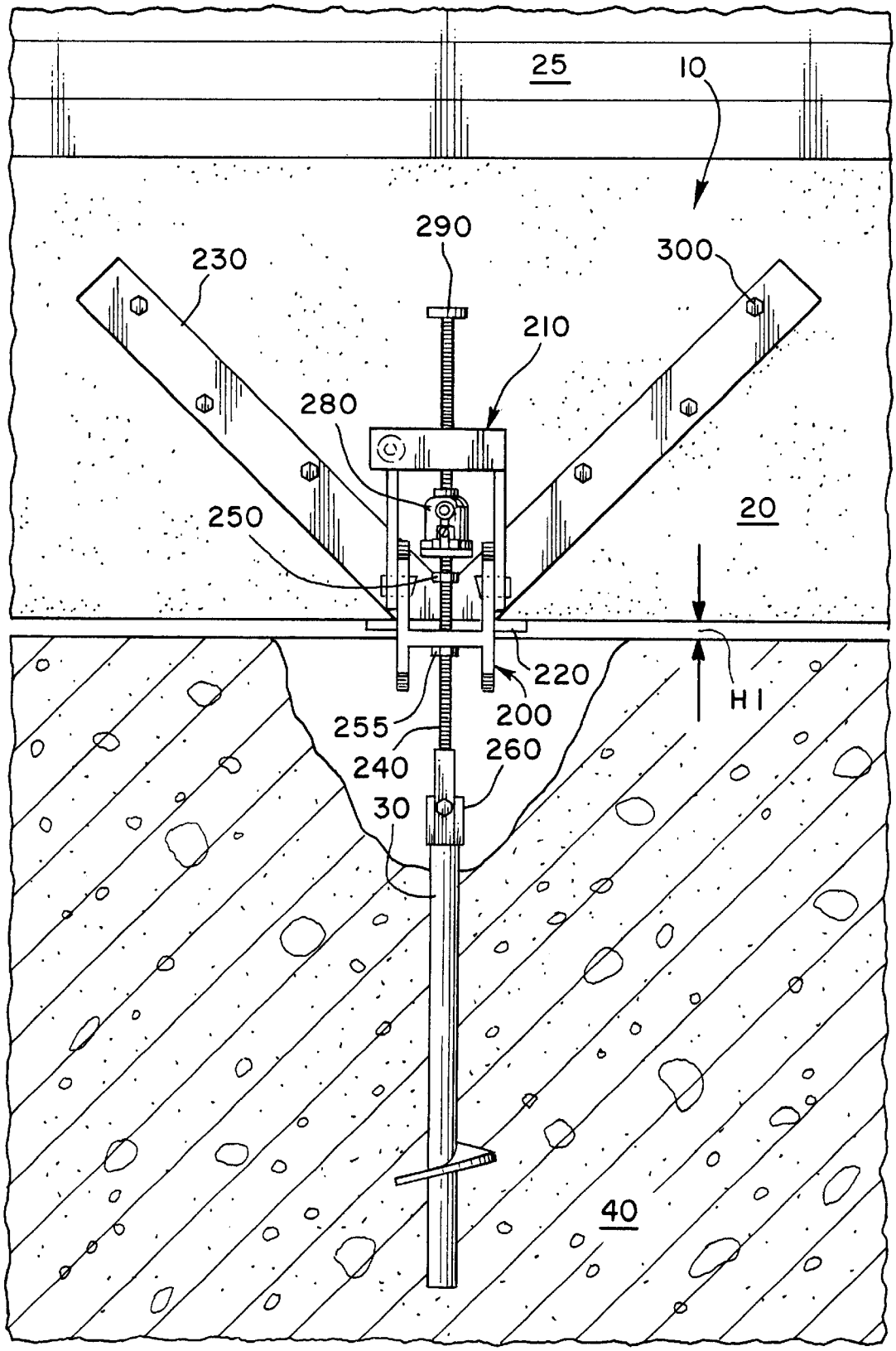
FIG. 3(*a*) is a front view of the apparatus of the present invention shown attached to the foundation of a structure before the foundation has been lifted.
Figure 3B:
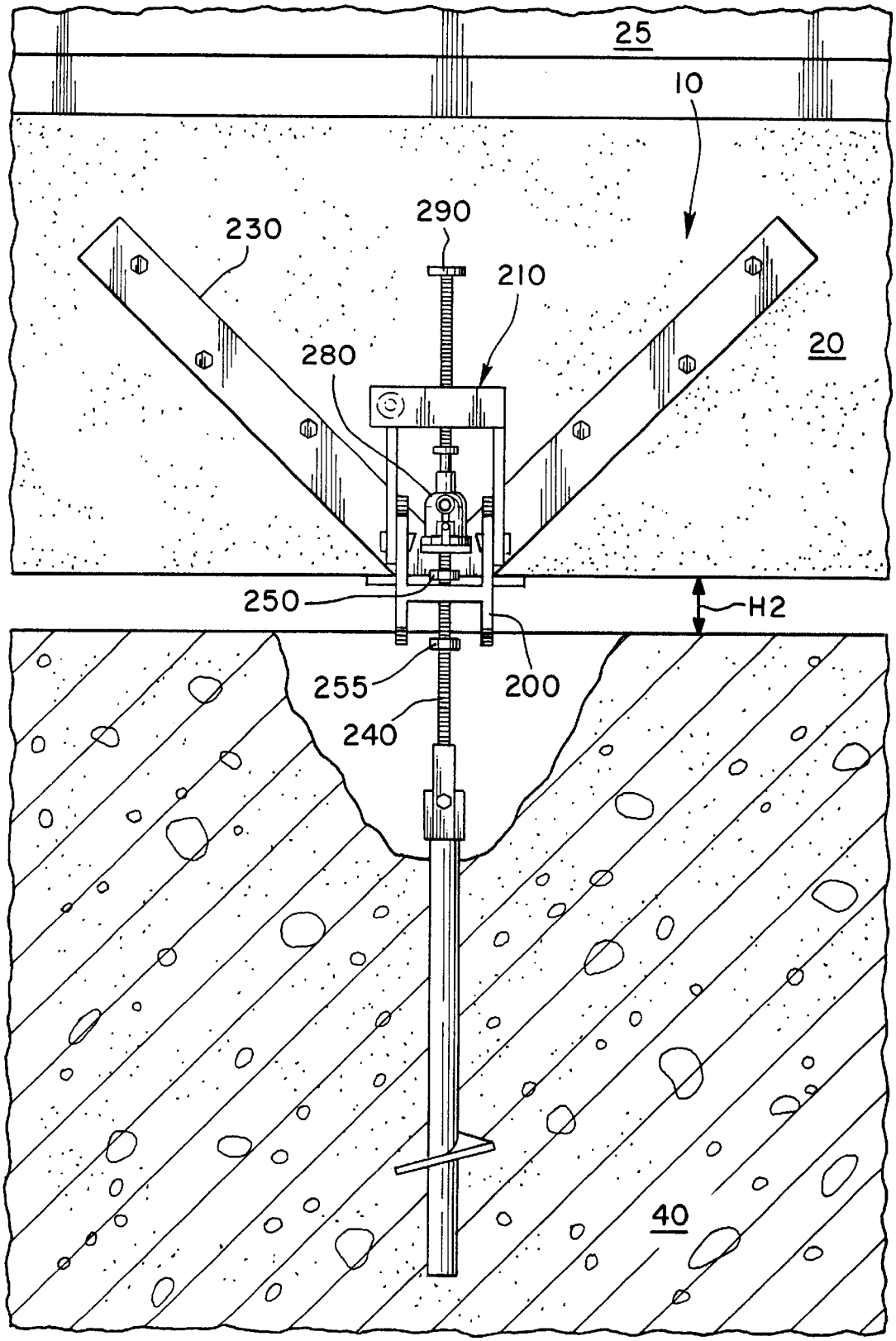
Figure 3C:
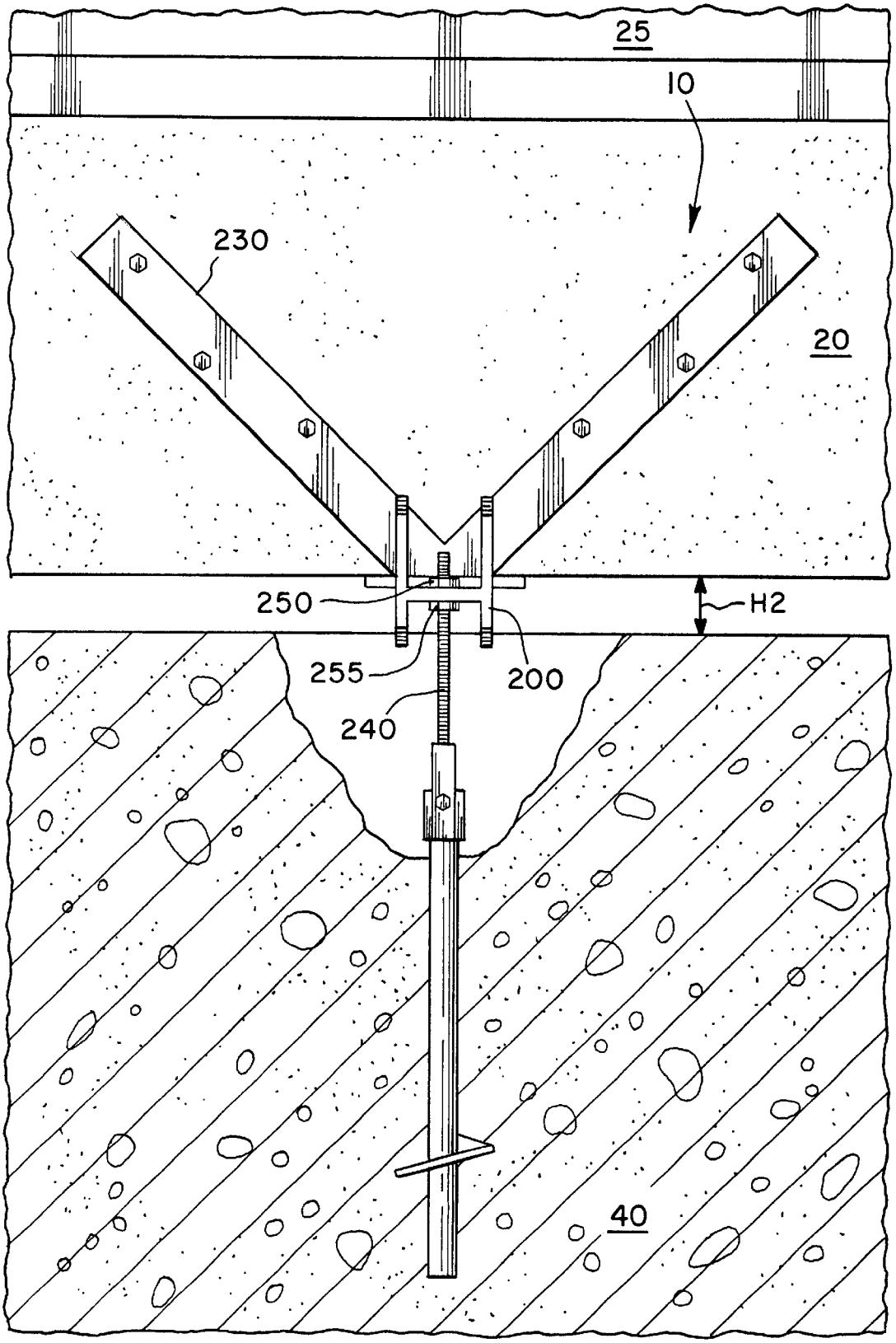

FIGS. 3(*a*) through 3(*c*) illustrate use of the apparatus 10 of the present invention. In FIG. 3(*a*) the foundation 20 of a structure 25 is shown at a distance H1 above the surface of the ground. A conventional pier 30 has been driven into the stable subsurface 40, and in this example, the surface of the ground has been excavated around the apparatus 10 to provide additional work area. The plate 220 of the support member 200 is slid under the foundation 20 and the rod 240 is slid through the hole 245 (see FIG. 2) formed in the support member 200 and interconnected to the pier 30 (e.g., using connector 260). The first anchor 250 can be placed on the rod 240 but not tightened against the support member 200 (i.e., to allow the support member 200 to slide along the rod 240). The second anchor 255 can be tightened against the lower surface of the support member 200 to hold the support member 200 in place. Next, the brace 230 is secured to the foundation 20 (and indeed can even be secured to the structure 25 itself in some embodiments) using suitable fasteners such as the conventional bolts 300 shown in FIG. 3(*a*). The lift bracket 210 is then fitted to the support member 200 as described above (i.e., by swinging movable arm 274 outward and engaging fitting 276 on stationary arm 272 in hole 202 and then swinging movable arm 274 inward and engaging fitting 276 thereon in hole 202). A jack 280 is placed on the upper end of the rod 240 and beneath the adjustable member 290 of the lift bracket 210. The adjustable member 290 can be loosened so that the jack 280 fits between the rod 240 and the lift bracket 210 and tightened to hold the jack 280 in place as needed to accommodate the jack 280 between the support member 200 and the lift bracket 210 (this reduces the distance the jack 280 must be operated before the jack 280 engages the lift bracket 210).

Once the apparatus 10 has been assembled as shown and described with respect to FIG. 3(*a*), the jack 280 is operated to lift the support member 200, and hence the foundation 20 to the desired elevation (e.g., H2 in FIG. 3(*b*)). That is, as the jack 280 is operated to apply a force between the lift bracket 210 and the support member 200, the lift bracket 210 is forced upward, drawing the attached support member 200 and foundation 20 along with it to the desired elevation H2, as shown in FIG. 3(*b*).

Having reached the desired elevation H2, the first and second anchors 250, 255 are tightened against the support member 200 as shown in FIG. 3(*c*). The lift bracket 210 and the jack 280 can then be removed from the support member 200. The adjustable member 290 can be loosened or the jack 280 can be lowered or a combination thereof to release the jack 280 from between the lift bracket 210 and the support member 200. The first and second anchors 250, 255 hold the support member 200 firmly in place relative to the rod to support the foundation in tension or compression. That is, should the unstable soil heave and push upward on the foundation 20, the first anchor 250 keeps the support member 200 and foundation 20 from being pushed upward (i.e., under tension). Likewise, the second anchor 255 maintains the support member 200 and foundation 20 at the desired elevation H2 under the weight of the structure 25 (i.e., under compression). It might not be necessary to use both nuts 250 and 255 depending on the type of load. The lift bracket 210 and jack 280 can then be reused to lift other support members 200.

It is to be expressly understood that the embodiment shown in FIGS. 3(*a*) through 3(*c*) and described above is merely illustrative of the present invention and is not intended to limit the scope thereof. For example, in some uses where the foundation 20 is sufficiently high above the ground, the surface soil need not be excavated. Similarly, the process can be repeated to raise or lower the foundation (e.g., where H2 becomes too great due to erosion and the foundation must be lowered). In addition, the assembly steps discussed above can occur in any order so long as the steps can be mechanically performed in that order without interfering with assembly or use of the apparatus 10.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described herein and above is further intended to explain the best mode presently known of practicing the invention and to enable others skilled in the art to utilize the invention as such, or in other embodiments, and with the various modifications required by their particular application or uses of the invention. It is intended that the appended claims be construed to include alternate embodiments to the extent permitted by the prior art.

I claim:

1. An apparatus for lifting and supporting a foundation of a structure relative to a pier anchored into the ground, said apparatus comprising:

a support member for lifting and supporting the foundation;

a rod passing through said support member and connected to the pier;

a lift bracket removably connected to said support member;

a jack, inserted between said rod and said lift bracket, said support member sliding along said rod when said jack exerts a force between said rod and said lift bracket to lift the foundation; and an anchor to secure said support member to said rod so that said support member is held firmly in place relative to said rod to support the foundation wherein said anchor comprises at least one fastener that threadably engages said rod.

2. The apparatus of claim 1, wherein said anchor comprises a pair of fasteners that threadably engage said rod.

3. The apparatus of claim 1, wherein said support member is connected to said foundation by a plate and a brace.

4. The apparatus of claim 3, wherein said brace is V-shaped.

5. The apparatus of claim 1, wherein said lift bracket further includes an adjustable member to accommodate said jack between said rod and said lift bracket.

6. The apparatus of claim 1, wherein said lift bracket further includes a movable arm and a stationary arm, said movable arm swung outward to fit said stationary arm of said lift bracket onto said support member and said movable arm then swung inward to fit said movable arm of said lift bracket onto said support member.

7. The apparatus of claim 6, wherein said movable arm and said stationary arm of said lift bracket further include connectors to engage said support member.

8. An apparatus for lifting and supporting a foundation of a structure relative to a pier anchored into the ground, said apparatus comprising:

a support member for lifting and supporting the foundation;

a rod connected to the pier and passing through said support member;

a lift bracket removably connected to said support member, said lift bracket having a movable arm and a stationary arm, said movable arm swung outward to fit said stationary arm of said lift bracket onto said support member and said movable arm then swung inward to fit said movable arm of said lift bracket onto said support member;

a jack, inserted between said rod and said lift bracket, said support member sliding along said rod when said jack exerts a force between said rod and said lift bracket to lift the foundation;

a pair of fasteners engaging said rod above and below said support member and securing said support member to said rod so that said support member is held firmly in place relative to said rod to support the foundation under tension and compression.

9. The apparatus of claim 8, wherein said support member has a plate and a brace, said plate slid beneath the foundation and said brace attached to a side of the foundation.

10. The apparatus of claim 8, wherein said fasteners threadably engage said rod.

11. The apparatus of claim 8, wherein said movable arm and said stationary arm of said lift member further include fittings to engage holes formed in said support member.

12. The apparatus of claim 8, wherein said lift bracket can be adjusted to tighten the jack between said rod and said lift bracket.

13. The apparatus of claim 8, wherein said lift bracket further comprises an adjustable member that can be adjusted to release the jack from between said rod and said lift bracket.

14. An apparatus for lifting and supporting a foundation of a structure under tension and compression relative to a pier anchored into the ground, said apparatus comprising:

a support member having:

a plate for engaging the foundation;

a brace connecting said support member to the foundation;

a rod passing through said support member and connected to the pier;

a first anchor engaging said rod above said support member and a second anchor engaging said rod below said support member, said support member slidable along said rod between said first anchor and said second anchor;

a removable lift bracket removably connected to said support member;

a jack inserted between said rod and said lift bracket;

said support member sliding along said rod between said first anchor and said second anchor when said jack exerts a force between said rod and said lift bracket to lift the foundation, said support member held firmly in place relative to said rod to support the foundation when said first anchor and said second anchor are tightened against said support member.

15. The apparatus of claim 14, wherein said brace is V-shaped.

16. The apparatus of claim 14, wherein said first and second anchors are fasteners that threadably engage said rod.

17. The apparatus of claim 14, wherein said lift bracket further includes an adjustable member to accommodate said jack between said rod and said lift bracket.

* * * * *